US005708718A

United States Patent [19]

Ambourn et al.

[11] Patent Number: 5,708,718

[45] Date of Patent: Jan. 13, 1998

[54] SURROUND SOUND PROCESSOR SYSTEM

[75] Inventors: Paul R. Ambourn; Robert Stockman, both of Milwaukee, Wis.

[73] Assignee: Sounds' So Real Accessories, Inc., Coon Rapids, Minn.

[21] Appl. No.: 605,751

[22] Filed: Feb. 22, 1996

[51] Int. Cl.[6] ..... H04S 1/00

[52] U.S. Cl. ..... 381/1; 381/27; 381/18

[58] Field of Search ..... 381/1, 27, 77, 381/28, 18

[56] References Cited

U.S. PATENT DOCUMENTS

| | | | |
|---|---|---|---|
| 3,757,047 | 9/1973 | Ito et al. | 179/1 GQ |
| 3,783,192 | 1/1974 | Takahashi | 381/21 |
| 3,941,931 | 3/1976 | Osakabe | 381/1 |
| 4,002,835 | 1/1977 | Bumber | 179/1 GQ |
| 4,049,912 | 9/1977 | Mitchell | 179/1 GQ |
| 4,097,688 | 6/1978 | Ochi | 179/1 GQ |
| 4,204,092 | 5/1980 | Bruney | 179/1 G |
| 4,495,637 | 1/1985 | Bruney | 381/1 |
| 4,594,729 | 6/1986 | Weingartner | 381/18 |
| 4,612,663 | 9/1986 | Holbrook et al. | 381/24 |
| 4,899,388 | 2/1990 | Mlodzikowski et al. | 381/77 |
| 4,908,858 | 3/1990 | Ohno | 381/1 |
| 5,077,797 | 12/1991 | Ishikawa | 381/3 |
| 5,155,770 | 10/1992 | Maejima | 381/18 |
| 5,197,100 | 3/1993 | Shiraki | 381/24 |
| 5,265,166 | 11/1993 | Madnick et al. | 381/1 |
| 5,349,386 | 9/1994 | Borchardt et al. | 381/14 |
| 5,412,732 | 5/1995 | Kanishi et al. | 381/18 |
| 5,425,106 | 6/1995 | Katz et al. | 381/97 |
| 5,491,839 | 2/1996 | Schotz | 381/79 |

*Primary Examiner*—Forester W. Isen

*Attorney, Agent, or Firm*—Donald J. Ersler

[57] ABSTRACT

A surround sound processor system includes an in-phase decoder circuit, an out-of-phase decoder circuit, and a plurality of audio amplifiers. In a wireless embodiment, the surround sound processor system also includes a plurality of FM transmitters and a plurality of FM receivers. A surround sound process system can take the stereo audio signal from a stereo VCR, a stereo receiver, a car stereo, or a stereo TV to produce a three dimensional sound field. A left audio signal and a right audio signal are input into an in-phase decoder, the in-phase audio signals are extracted from the left and right audio signals while the out-of-phase audio signals are canceled. The in-phase audio signals are sent to an audio amplifier and then to at least one center speaker. A left audio signal and a right audio signal are input into an out-of-phase decoder, the out-of-phase audio signals are extracted from the left and right audio signals while the in-phase audio signals are canceled. The out-of-phase audio signals are sent to an audio amplifier and then to at least one rear speaker. The wireless surround sound processor utilizes an FM transmission link as opposed to hard wiring.

10 Claims, 3 Drawing Sheets

SURROUND SOUND PROCESSOR SYSTEM

FIELD OF THE INVENTION

The present invention relates generally to surround sound processor systems and more specifically to a surround sound processor system that is simpler and more economical than that of the prior art.

DISCUSSION OF THE PRIOR ART

Surround sound processors are used in the decoding of audio signals. Stereo audio signals are decoded into in-phase signals and out-of-phase signals. The in-phase signals will be sent to at least one center speaker. The out-of-phase signals will be sent to at least one rear speaker. In a normal surround sound system, there are five speakers, there are two stereo speakers in the front, a center speaker positioned between the two stereo speakers and two rear speakers in the back. The five speakers create a three dimensional sound field similar to that in a modern movie theater.

The prior art consists of surround sound processors that have complicated decoder circuitry which necessitates an expensive selling price. The prior art surround sound processor units are either a three channel add on unit which includes audio amplifiers and which is used in conjunction with a stereo receiver, or a five channel stand alone unit which has audio amplifiers for all five channels instead of three channels. Speakers are connected to either surround sound processor unit with cumbersome speaker wires. The prior art surround sound processor units are expensive and do not allow for wireless operation.

Accordingly, there is a clearly felt need in the art for a surround sound processor system that has a simpler design, an economical price and allows the user to have the flexibility of putting speakers anywhere in a room.

SUMMARY OF THE INVENTION

The primary objective of the present invention is to provide a surround sound processor system which has a simpler design, an economical cost and allows a user to locate speakers in a room without routing speaker wires.

According to the present invention, a surround sound processor system includes an in-phase decoder circuit, an out-of-phase decoder circuit, a plurality of FM transmitters, a plurality of FM receivers, and a plurality of audio amplifiers. A stereo audio signal includes a left audio signal and a right audio signal. The stereo audio signal can come from a stereo VCR audio out, a home stereo receiver pre-amplifier out, a car stereo pre-amplifier out or a stereo TV audio out.

The in-phase decoder circuit includes an input for the left audio signal and an input for the right audio signal. The left audio signal is input by a left input resistor, the right audio signal is input by a right input resistor. The left input resistor and the right input resistor are connected to each other and to a tap of a distortion reducing potentiometer. A left ground of the left audio signal and a right ground of the right audio signal are connected to each other and to the distortion reducing potentiometer. The in-phase signal is output across the distortion reducing potentiometer.

The out-of-phase decoder circuit includes an input for the left audio signal and an input for the right audio signal. The left audio signal is input by a left input resistor and a DC stripping capacitor. The right audio signal is input by a right input resistor. The right input resistor and the left input resistor are connected to each other. A left ground of the left audio signal and a right ground of the right audio signal are connected to each other. The DC stripping capacitor is connected to the tap of the distortion reducing potentiometer. The out-of-phase signal is output across the distortion reducing potentiometer.

In the first embodiment, the out-of-phase signal is transmitted by a first FM transmitter. The out-of-phase signal is received from the first FM transmitter by a first FM receiver. The out-of-phase signal is fed into a first audio amplifier, the first audio amplifier is connected to at least one rear speaker. The in-phase signal is transmitted by a second FM Transmitter. The in-phase signal is received from the second FM transmitter by a second FM receiver. The in-phase signal is fed into a second audio amplifier; the second audio amplifier is connected to at least one center speaker.

In the second embodiment, the out-of-phase signal is fed into a first audio amplifier; the first audio amplifier is connected to at least one rear speaker. The in-phase signal is fed into a second audio amplifier; the second audio amplifier is connected to at least one center speaker.

Accordingly, it is an object of the present invention to provide a surround sound processor system that has simpler decoding circuitry than that of the prior art.

It is a further object of the present invention to provide a surround sound processor system that is less expensive than that of the prior art.

It is yet another object of the present invention to provide a surround sound processor system which can have wireless operation instead of the burdensome hard wire operation of the prior art.

Finally, it is another object of the present invention to provide a surround sound processor system which has in-phase decoding and out-of-phase decoding units that can be purchased separately instead of being one unit as in the prior art systems.

These and additional objects, advantages, features and benefits of the present invention will become apparent from the following specification.

DETAILED DESCRIPTION OF THE PREFERRED EMBODIMENTS

Figure 1:
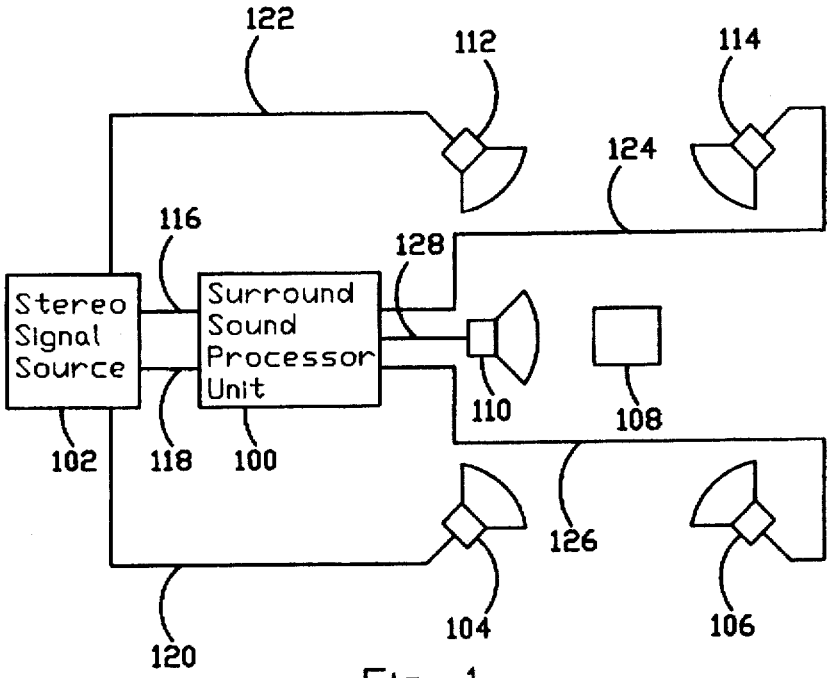
Fig. 1 (Prior Art)
FIG. 1 is a block diagram of a prior art three channel add on surround sound processor unit.

With reference now to the drawings, and particularly to FIG. 1, there is shown a prior art three channel stand alone surround sound processor unit 100. A stereo signal source 102 outputs a left audio signal through a left audio signal wire 116 and a right audio signal through a right audio signal wire 118 into a surround sound processor unit 100. The stereo signal source 102 can be a stereo VCR, a stereo receiver, a car stereo or a stereo TV.

The stereo signal source 102 also outputs a left front channel 122 and a right front channel 120. The surround sound processor unit 100 amplifies and decodes the left audio signal 116 and the right audio signal 118 into a three channel output. The three channel output comprises a center channel 128, a left rear channel 124 and a right rear channel 126. The audio signal in the left front channel 122 is an amplified version of the left audio signal 116. The audio signal in the right front channel 120 is an amplified version of the right audio signal 118. An in-phase audio signal is decoded from the left audio signal 116 and the right audio signal 118 and is output to the center channel 128. An out-of-phase audio signal is decoded from the left audio signal 116 and the right audio signal 118 and is output to the left rear channel 124 and the right rear channel 126.

A left front speaker 112 is connected to the right front channel 122. A center speaker 110 is connected to the center channel 128. A right front speaker 104 is connected to the right front channel 120. A left rear speaker 114 is connected to the left rear channel 124. A right rear speaker 106 is connected to the right rear channel 126. A listener sits at a location 108 and hears a three dimensional sound field, similar to that in a modern movie theater.

Figure 2:
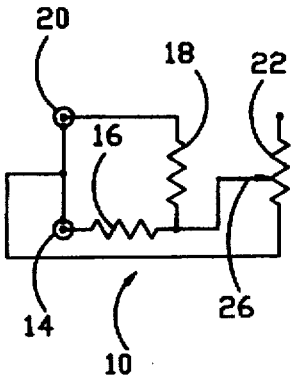
FIG. 2 is a schematic diagram of an in-phase decoder circuit of a surround sound processor system in accordance with the present invention.

FIG. 2 shows a schematic diagram of an in-phase decoder circuit 10. The in-phase decoder circuit 10 includes a left input resistor 18, a right input resistor 16 and a distortion reducing potentiometer 22. A left audio signal is input into the left input resistor 18 and a right audio signal is input into the right input resistor 16. The left audio signal has a left ground 20 which is connected to a right ground 14 of the right audio signal which is also connected to a distortion reducing potentiometer 22. The left input resistor 18, the right input resistor 16 and a tap 26 of distortion reducing potentiometer 22 are all connected.

When the left and right audio signals are in-phase, the left input resistor 18 and the right input resistor 16 add the left and right audio signals together. When the left and right audio signals are out-of-phase, the left input resistor 18 and the right input resistor 16 subtract the left audio signal from the right audio signal, this subtraction has the effect of canceling the out-of-phase signals. Distortion reducing potentiometer 22 removes unwanted noise from the in-phase signal by voltage division. The in-phase signal is output across the distortion reducing potentiometer 22.

Preferred values are given for the following elements as example and not by way of limitation. The in-phase decoder circuit 10 has been found to perform satisfactorily when the left input resistor 18 and right input resistor 16 each have a value of 1K ohms, and the distortion reducing potentiometer 22 has a value of 5K ohms.

Figure 3:
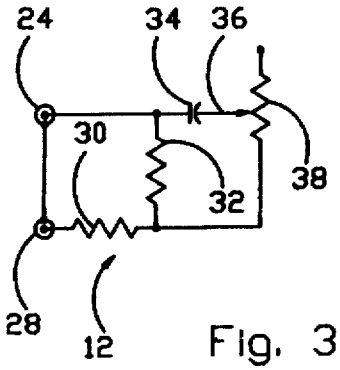
FIG. 3 is a schematic diagram of an out-of-phase decoder circuit of a surround sound processor system in accordance with the present invention.

FIG. 3 shows a schematic diagram of an out-of-phase decoder circuit 12. The out-of-phase decoder circuit 12 includes a left input resistor 32, a right input resistor 30, a distortion reducing potentiometer 38 and a DC stripping capacitor 34. A left audio signal is input into the left input resistor 32 and the DC stripping capacitor 34. A right audio signal is input into the right input resistor 30. The left audio signal has a left ground 24 which is connected to a right ground 28 of the right audio signal. The left input resistor 32, the right input resistor 30, and the distortion reducing potentiometer 32 are all connected. The DC stripping capacitor 34 is connected to a tap 36 of the distortion reducing potentiometer 38.

When the left and right audio signals are out-of-phase, the left input resistor 32 and the right input resistor 30 add the left and right audio signals together. When the left and right audio signals are in-phase, the left input resistor 32 and the right input resistor 30 subtract the left audio signal from the right audio signal, this subtraction has the effect of canceling the in-phase signals. The DC stripping capacitor 34 removes the DC bias voltage from the out-of-phase signal. Distortion reducing potentiometer 38 removes unwanted noise from the out-of-phase signal by voltage division. The out-of-phase signal is output across the distortion reducing potentiometer 38.

Preferred values are given for the following elements as example and not by way of limitation. The out-of-phase decoder circuit 10 has been found to perform satisfactorily when the left input resistor 32 and right input resistor 30 each have a value of 1K ohms, the DC stripping capacitor 34 has a value of 0.1 micro farads, and the distortion reducing potentiometer 22 has a value of 5K ohms.

Figure 4:
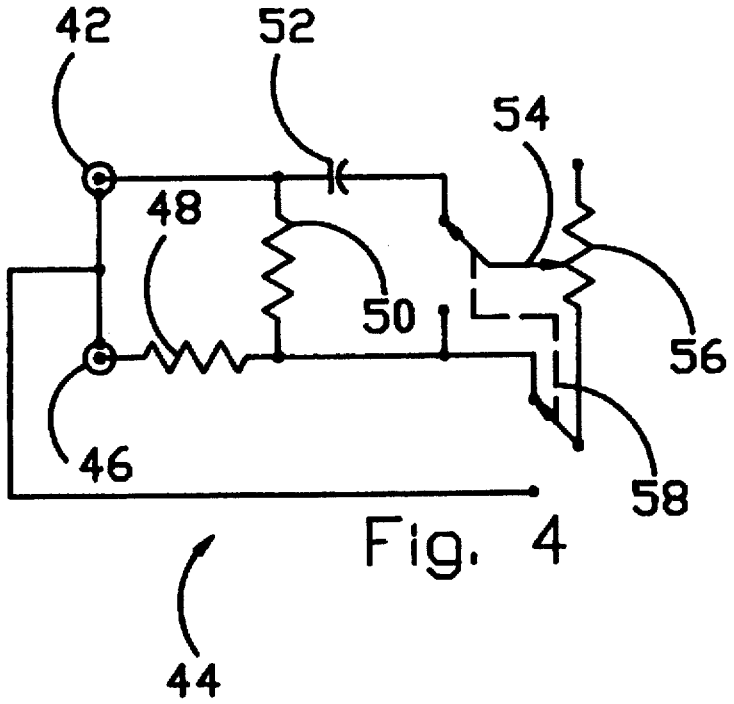
FIG. 4 is a schematic diagram of a combination circuit which allows switching from an in-phase decoder circuit to an out-of-phase decoder circuit of a surround sound processor system, the switch being located in a position to choose an out-of-phase decoder circuit in accordance with the present invention.
Figure 5:
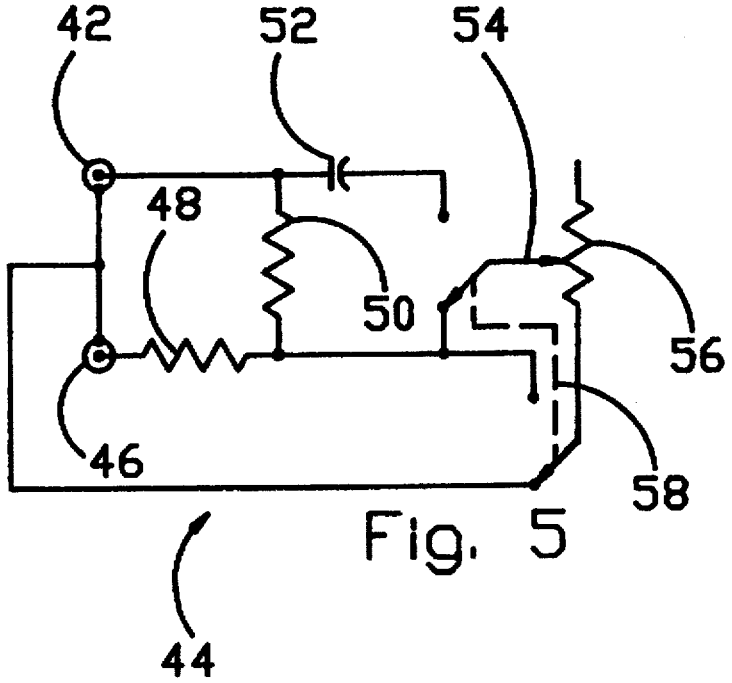
FIG. 5 is a schematic diagram of a combination circuit which allows switching from an in-phase decoder circuit to an out-of-phase decoder circuit of a surround sound processor system, the switch being located in a position to choose an in-phase decoder circuit in accordance with the present invention.

FIGS. 4 and 5 are schematic diagrams of a combination circuit 44 which allows switching from an in-phase decoder circuit to an out-of-phase decoder circuit. The out-of-phase decoder circuit 12 includes a left input resistor 50, a right input resistor 48, a distortion reducing potentiometer 56, a DC stripping capacitor 52, and a switch 58. A left audio signal is input into the left input resistor 50 and the DC stripping capacitor 52. A right audio signal is input into the right input resistor 48. The left audio signal has a left ground 42 which is connected to a right ground 46 of the right audio signal.

The switch 58 is positioned to select an out-of-phase decoder circuit in FIG. 4. The switch 58 couples the DC stripping capacitor 52 to a tap 54 of the distortion reducing potentiometer 56. The left input resistor 50, the right input resistor 48 and the distortion reducing potentiometer 56 are also coupled by the switch 58. The switch 58 can be any suitable double pole, double throw switch.

The switch 58 is positioned to select an in-phase decoder circuit in FIG. 5. The switch 58 couples a tap 54 of distortion reducing potentiometer 56 to the left input resistor 50 and the right input resistor 48. The left ground 42, the right ground 46 and the distortion reducing potentiometer 56 are also coupled by the switch 58.

The operation of the in-phase decoder circuit and the out-of-phase decoder circuit found in combination circuit 44 are identical to those found in FIG. 2 and FIG. 3, respectively.

Preferred values are given for the following elements as example and not by way of limitation. The out-of-phase decoder circuit 10 has been found to perform satisfactorily when the left input resistor 50 and right input resistor 48 each have a value of 1K ohms, the DC stripping capacitor 52 has a value of 0.1 micro farads, and distortion reducing potentiometer 56 has a value of 5K ohms.

Figure 6:
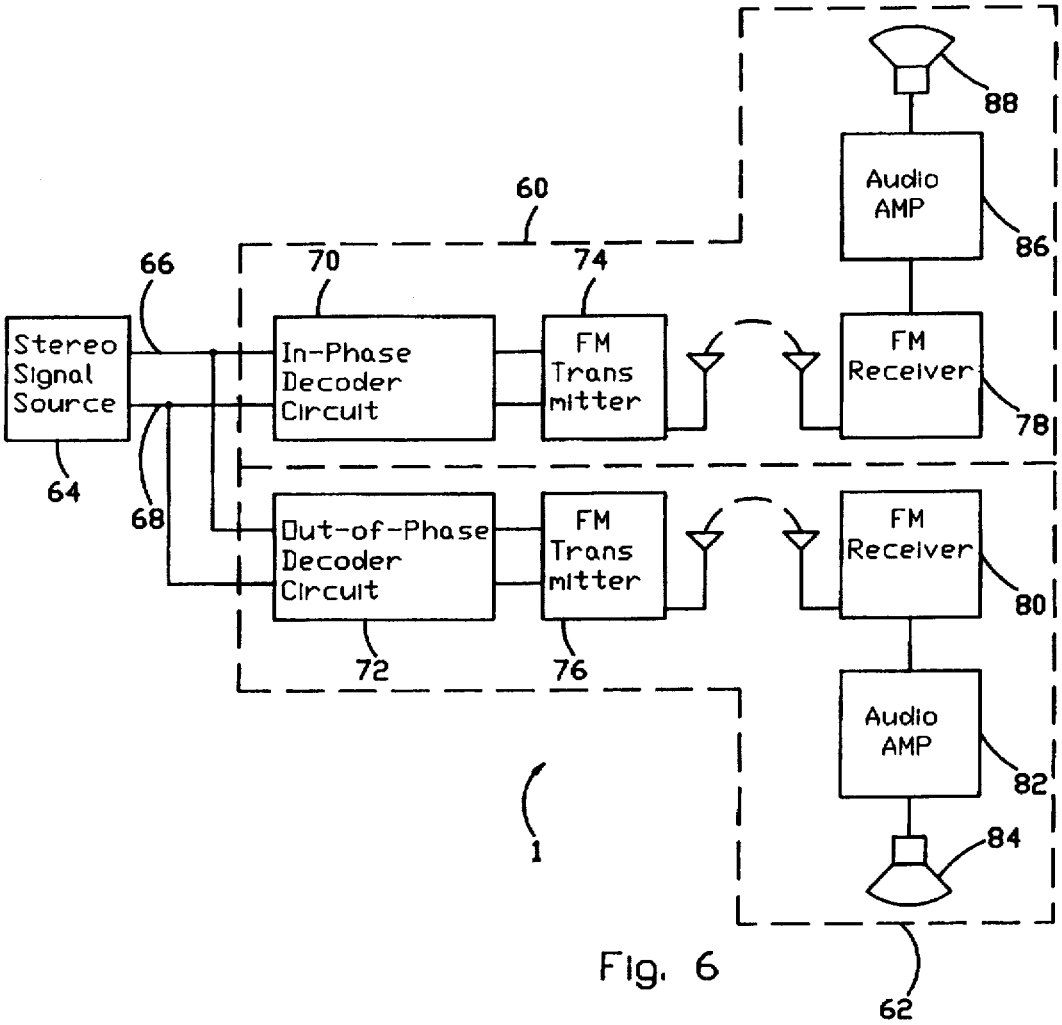
FIG. 6 is a block diagram of a wireless embodiment of a surround sound processor system in accordance with the present invention.

FIG. 6 shows a block diagram of a wireless surround sound processor system 1. The wireless surround sound processor system 1 comprises a stereo signal source 64, a left audio signal wire 66, a right audio signal wire 68, a wireless in-phase decoder circuit 60 and a wireless out-of-phase circuit 62. The wireless in-phase decoder circuit 60 includes an in-phase decoder circuit 70, a first FM transmitter 74, a first FM receiver 78, a first audio amplifier 86, and a center speaker 88, the quantity of the center speaker 88 is at least one. The wireless out-of-phase decoder circuit 62 includes an out-of-phase decoder circuit 72, a second FM transmitter 76, a second FM receiver 80, a second audio amplifier 82, and a rear speaker 84, the quantity of the rear speaker 84 is at least one.

The first FM transmitter 74, the second FM transmitter 76, the first FM receiver 78, the second FM receiver 80, the first audio amplifier 86, the second audio amplifier 82, the rear speaker 84, and the center speaker 88 are well known in the art. The first FM transmitter 74 and the second FM transmitter 76 need only be powerful enough to transmit approximately 30 to 50 feet and would comply with FCC regulations.

A stereo signal source 64 outputs a left audio signal through a left audio signal wire 66 and a right audio signal through a right audio signal wire 68 into the in-phase decoder circuit 70 and into the out-of-phase decoder circuit 72. The in-phase signal is fed into the first FM transmitter 74 from the in-phase decoder circuit 70. The first FM receiver 78 receives the in-phase signal from the first FM transmitter 74, the first audio amplifier 86 amplifies the in-phase signal which is then fed into the center speaker 88.

The out-of-phase signal is fed into the second FM transmitter 76 receives from the out-of-phase decoder circuit 72. The second FM receiver 80 receives the out-of-phase signal from the second FM transmitter 76, the second audio amplifier 82 amplifies the out-of-phase signal which is then fed into the rear speaker 84.

The first FM receiver 78 and the second FM receiver 80 are tuned to a frequency between 88–91 megahertz. The exact frequency is determined by finding a dead spot in the FM band which varies from location to location. The first FM transmitter 74 and the second FM transmitter 76 are tuned to the exact frequency of the first FM receiver 78 and the second FM receiver 80, respectively. If both the in-phase decoder circuit 70 and the out-of-phase decoder circuit 72 are used, a different frequency setting is used for each FM receiver/transmitter set.

Figure 7:
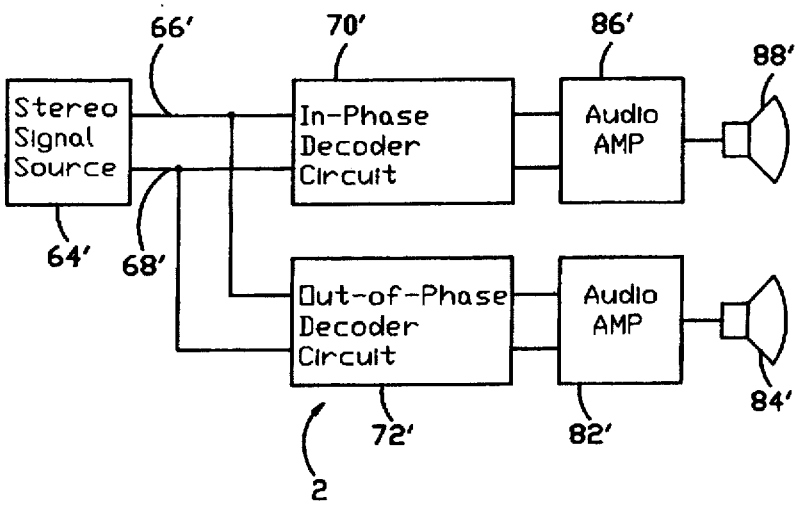
FIG. 7 is a block diagram of a hard wire embodiment of a surround sound processor system in accordance with the present invention.

FIG. 7 is a block diagram of a hard wire embodiment of a surround sound processor system 2. The hard wire surround sound processor system 2 includes a stereo signal source 64', a left audio signal wire 66', a right audio signal wire 68', an in-phase decoder circuit 70', an out-of phase decoder circuit 72', a first audio amplifier 86', a second audio amplifier 82', a center speaker 88', and a rear speaker 84'. The quantities of center speaker 88'and rear speaker 84' each can be more than one.

The stereo signal source 64' outputs the left audio signal through a left audio signal wire 66' and the right audio signal through a right audio signal wire 68' into the in-phase decoder circuit 70' and into the out-of-phase decoder circuit 72'. The first audio amplifier 86' amplifies the in-phase signal which is then sent to the center speaker 88'. The second audio amplifier 82' amplifies the out-of-phase signal which is then sent to the rear speaker 84'.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. An in-phase decoder circuit for use in a surround sound processor system comprising:

a left input resistor;

a right input resistor;

a potentiometer having a tap, said left input resistor and said right input resistor being connected to said tap of said potentiometer; and wherein a left audio signal and a right audio signal being derived from a stereo audio signal, said left audio signal being input into said left input resistor, said right audio signal being input into said right input resistor, said left audio signal having a left ground, said right audio signal having a ground, said potentiometer being connected to said left ground of said left audio signal and said right ground of said right audio signal, a plurality of in-phase signals in said left audio signal and said right audio signal being added, a plurality of out-of-phase signals in said left and right audio signals being canceled, said plurality of in-phase signals being output across said potentiometer.

2. The in-phase decoder circuit for use in a surround sound processor system of claim 1, further comprising:

a FM radio frequency transmitter which transmits a plurality of in-phase signals from said in-phase decoder circuit to a FM radio frequency receiver.

3. An out-of-phase decoder circuit for use in a surround sound processor system comprising:

a capacitor;

a left input resistor, said capacitor being connected to said left input resistor;

a right input resistor; and wherein a left audio signal and a right audio signal being derived from a stereo audio signal, said left audio signal being input into said left input resistor and said capacitor, said right audio signal being input into said right input resistor, a plurality of out-of-phase signals in said left and right audio signal being added, a plurality of in-phase signals in said left and right audio signals being canceled.

4. The out-of-phase decoder circuit for use in a surround sound processor system of claim 3 further comprising:

a potentiometer having a tap, said capacitor being connected to said tap of said potentiometer, said left input resistor, said right input resistor and said potentiometer being connected to each other;

said left audio signal having a left ground;

said right audio signal having a right ground; and wherein said left ground of said left audio signal and said right ground of said right audio signal being connected to each other, said plurality of out-of-phase signals being input into said tap of said potentiometer, said plurality of out-of-phase signals being output across said potentiometer.

5. The out-of-phase decoder circuit for use in a surround sound processor system of claim 3, further comprising:

a FM radio frequency transmitter which transmits a plurality of out-of-phase signals from said out-of-phase decoder circuit to a FM radio frequency receiver.

6. A combination circuit which allows switching from an in-phase decoder circuit to an out-of-phase decoder circuit for use in a surround sound processor system comprising:

a left input resistor;

a right input resistor, said left input resistor being connected with said right input resistor;

a potentiometer having a tap;

a switch having a first position and a second position;

a capacitor, said capacitor being connected to said left input resistor, said capacitor being coupled to said tap of said potentiometer when said switch is in said first position, said potentiometer being coupled with said left input resistor and said right input resistor when said switch is in said first position; and wherein said tap of said potentiometer being coupled to said left and right input resistor when said switch is in said second position.

7. The combination circuit which allows switching from an in-phase decoder circuit to an out-of-phase decoder circuit for use in a surround sound processor system of claim 6 further comprising:

said left audio signal having a left ground;

said right audio signal having a right ground, said left ground of said left audio signal and said right ground of said right audio signal being connected to each other; and wherein said left audio signal and said right audio signal being derived from a stereo audio signal, said left audio signal being input into said left input resistor and said capacitor, said right audio signal being input into said right input resistor, a plurality of out-of-phase signals in said left and right audio signal being added, a plurality of in-phase signals in said left and right audio signals being canceled, said plurality of out-of-phase signals being input into said tap of said potentiometer, said plurality of out-of-phase signals being output across said potentiometer.

8. The combination circuit which allows switching from an in-phase decoder circuit to an out-of-phase decoder circuit for use in a surround sound processor system of claim 5 further comprising:

said left audio signal having a left ground;

said right audio signal having a right ground, said potentiometer being coupled to said left ground of said left audio signal and said right ground of said right audio signal when said switch is in said second position; and wherein said left audio signal and said right audio signal being derived from a stereo audio signal, said left audio signal being input into said left input resistor, said right audio signal being input into said right input resistor, a plurality of in-phase signals in said left audio signal and said right audio signal being added, a plurality of out-of-phase signals in said left and right audio signals being canceled, said plurality of in-phase signals being input into said tap of said potentiometer, said plurality of in-phase signals being output across said potentiometer.

9. The combination circuit which allows switching from an in-phase decoder circuit to an out-of-phase decoder circuit for use in a surround sound processor system of claim 6, further comprising:

a FM radio frequency transmitter which transmits a plurality of out-of-phase signals from said out-of-phase decoder circuit to a FM frequency receiver.

10. The combination circuit which allows switching from an in-phase decoder circuit to an out-of-phase decoder circuit for use in a surround sound processor system of claim 6, further comprising:

a FM radio frequency transmitter which transmits a plurality of in-phase signals from said in-phase decoder circuit to a FM radio frequency receiver.

* * * * *